US011445752B2

(12) United States Patent
Liu et al.

(10) Patent No.: US 11,445,752 B2
(45) Date of Patent: Sep. 20, 2022

(54) ULTRASONIC ELECTRONIC CIGARETTE ATOMIZER AND ELECTRONIC CIGARETTE

(71) Applicant: CHINA TOBACCO HUNAN INDUSTRIAL CO., LTD., Hunan (CN)

(72) Inventors: Jianfu Liu, Hunan (CN); Kejun Zhong, Hunan (CN); Xiaoyi Guo, Hunan (CN); Wei Huang, Hunan (CN); Xinqiang Yin, Hunan (CN); Jianhua Yi, Hunan (CN); Yang Wang, Hunan (CN); Yongquan Zhou, Hunan (CN)

(73) Assignee: CHINA TOBACCO HUNAN INDUSTRIAL CO., LTD., Hunan (CN)

( * ) Notice: Subject to any disclaimer, the term of this patent is extended or adjusted under 35 U.S.C. 154(b) by 301 days.

(21) Appl. No.: 16/613,356

(22) PCT Filed: May 16, 2018

(86) PCT No.: PCT/CN2018/087072

§ 371 (c)(1),
(2) Date: Nov. 13, 2019

(87) PCT Pub. No.: WO2018/210264

PCT Pub. Date: Nov. 22, 2018

(65) Prior Publication Data

US 2021/0076733 A1 Mar. 18, 2021

(30) Foreign Application Priority Data

May 16, 2017 (CN) ..... 201720535917.0
May 23, 2017 (CN) ..... 201720577454.4

(51) Int. Cl.
*A24F 40/40* (2020.01)
*A24F 40/05* (2020.01)
(Continued)

(52) U.S. Cl.
CPC ..... *A24F 40/40* (2020.01); *A24F 40/05* (2020.01); *A24F 40/44* (2020.01); *A24F 40/48* (2020.01);
(Continued)

(58) Field of Classification Search
CPC ..... A24F 40/05; A24F 40/40; A24F 40/44; A24F 40/48
See application file for complete search history.

(56) References Cited

U.S. PATENT DOCUMENTS

2019/0166905 A1 6/2019 Liu et al.
2020/0305500 A1* 10/2020 Liu ..... A24F 40/05

FOREIGN PATENT DOCUMENTS

CN 105559151 A * 5/2016 ..... A24F 40/05
CN 205432145 U * 8/2016
(Continued)

OTHER PUBLICATIONS

International Search Report issued in International Application No. PCT/CN2018/087072 dated Jul. 31, 2018, 4 pages.
(Continued)

*Primary Examiner* — Hae Moon Hyeon
(74) *Attorney, Agent, or Firm* — Mauriel Kapouytian Woods LLP; Liang Huang; Michael Mauriel

(57) ABSTRACT

An ultrasonic electronic cigarette atomizer and an electronic cigarette are disclosed. The atomizer includes a housing, a nozzle assembly that is connected to one end of the housing, an air inlet channel, an air outlet channel, and an ultrasonic atomization sheet that is disposed in the housing. The air inlet channel, an atomization region of the ultrasonic atomization sheet, and the air outlet channel are sequentially communicated. An outlet of the air inlet channel is opposite to the atomization region of the ultrasonic atomization sheet. The nozzle assembly comprises a nozzle holder mounted to one end of the housing, and a suction portion on the nozzle holder communicated with the air outlet channel.

20 Claims, 11 Drawing Sheets

(51) Int. Cl.

| | |
|---|---|
| ***A24F 40/485*** | (2020.01) |
| ***A24F 40/48*** | (2020.01) |
| ***A24F 40/44*** | (2020.01) |
| ***B05B 17/06*** | (2006.01) |
| *A24F 40/10* | (2020.01) |

(52) U.S. Cl.
CPC ..... *A24F 40/485* (2020.01); *B05B 17/0684* (2013.01); *A24F 40/10* (2020.01)

(56) References Cited

FOREIGN PATENT DOCUMENTS

| | | | | | |
|---|---|---|---|---|---|
| CN | 205757212 | U | | 12/2016 | |
| CN | 205912905 | U | | 2/2017 | |
| CN | 205962833 | U | | 2/2017 | |
| CN | 206025225 | U | * | 3/2017 | ..... A24F 47/008 |
| CN | 206025226 | U | * | 3/2017 | |
| CN | 206025226 | U | | 3/2017 | |
| CN | 206949535 | U | | 2/2018 | |
| CN | 206949536 | U | | 2/2018 | |

OTHER PUBLICATIONS

European Search Report issued in European Application No. 18802335.2 dated Apr. 12, 2020, 7 pages.

* cited by examiner

ULTRASONIC ELECTRONIC CIGARETTE ATOMIZER AND ELECTRONIC CIGARETTE

CROSS REFERENCE TO RELATED APPLICATIONS

This application is a U.S. National Phase application under 35 U.S.C. § 371 of International Application No. PCT/CN2018/087072 filed on May 16, 2018, which claims priority to Chinese Application Number 201720535917.0 filed on May 16, 2017, and Chinese Application Number 201720577454.4 filed on May 23, 2017.

FIELD OF THE INVENTION

The present invention belongs to the technical field of electronic cigarettes, and specifically relates to an ultrasonic electronic cigarette atomizer and an electronic cigarette.

BACKGROUND OF THE INVENTION

The existing ultrasonic electronic cigarette atomizer on the market comprises a housing, a nozzle assembly is connected to one end of the housing, an air inlet is formed on a side wall of the housing, and an air inlet channel, an air outlet channel and an ultrasonic atomization sheet for ultrasonically atomizing e-liquid are disposed in the housing, wherein the air inlet, the air inlet channel, an atomization region of the ultrasonic atomization sheet, the air outlet channel, and the nozzle assembly are sequentially communicated; an e-liquid chamber and an e-liquid guide cotton for communicating the e-liquid chamber with an atomization surface of the ultrasonic atomization sheet are further disposed in the housing. The existing ultrasonic electronic cigarette atomizer has the following deficiencies:

First, the air flow channel is not disposed reasonably: the atomization region of the ultrasonic atomization sheet is opposite to an inlet of the air outlet channel, and air flow enters from a side of the ultrasonic atomization sheet, and then flows from the air outlet channel to the nozzle assembly. The air outlet channel is perpendicular to the ultrasonic atomization sheet, smoke generated by the ultrasonic atomization sheet is directly sprayed to a user's mouth when e-liquid is atomized, and large particles of e-liquid in the smoke are also splashed to the user's mouth, so the mouthfeel of the smoke is poor. Meanwhile, the large particles of e-liquid easily scald the mouth due to their high temperature. In addition, when the user holds the electronic cigarette to smoke, the hand easily blocks the air inlet on the side wall of the housing, therefore block the air inlet channel, so that the user experience is poor.

Second, the e-liquid guide cotton is of a single-layer structure, and the center of the ultrasonic atomization sheet is a core region for atomization, so the atomization temperature is highest and the amplitude is maximum in the center of the ultrasonic atomization sheet. The single-layer e-liquid guide cotton is aged rapidly in the center of the ultrasonic atomization sheet, and may be broken by shocking within a short time, leads to the center of the ultrasonic atomization sheet is not covered by the e-liquid guide cotton, the amount of atomized smoke is reduced, and the service life of the ultrasonic atomization sheet is shortened.

Third, the e-liquid path cannot be cut off, so that e-liquid accumulation easily occurs on the surface of the ultrasonic atomization sheet. Especially when the atomizer is not used for a long time, the e-liquid may constantly permeate the ultrasonic atomization sheet, causing the phenomena of e-liquid leakage and e-liquid immersion, which results in low atomization start speed of the ultrasonic atomization sheet.

SUMMARY OF THE INVENTION

The air flow channel of the existing ultrasonic electronic cigarette atomizer is not disposed reasonably, so that the e-liquid guide cotton is easily burnt out, and e-liquid leakage and e-liquid immersion easily occur. For the above deficiencies of the prior art, an objective of the present invention is to provide an improved ultrasonic electronic cigarette atomizer and an electronic cigarette, in which the air flow channel is disposed reasonably, smoke is not directly sprayed to a user's mouth, the phenomenon of sucking large particles of e-liquid in the smoke or scalding the mouth is avoided, and the air inlet is not easily blocked by a hand; the e-liquid guide cotton has a long service life, a large amount of smoke is generated, and the ultrasonic atomization sheet has a long service life; the e-liquid path can be cut off, the phenomena of e-liquid leakage and e-liquid immersion are not easy to occur, and the atomization start speed is fast.

In order to solve the above technical problems, the technical solution adopted by the present invention is as follows:

An ultrasonic electronic cigarette atomizer, comprising a housing; a nozzle assembly is connected to one end of the housing; an air inlet channel, an air outlet channel and an ultrasonic atomization sheet are disposed in the housing; the air inlet channel, an atomization region of the ultrasonic atomization sheet and the air outlet channel are sequentially communicated; the atomizer has the structural characteristics that an outlet of the air inlet channel is opposite to the atomization region of the ultrasonic atomization sheet; the nozzle assembly comprises a nozzle holder and a suction portion; the nozzle holder is mounted to one end of the housing; the suction portion is located on the nozzle holder and is communicated with the air outlet channel; the end of the suction portion that is close to the nozzle holder is provided with an air inlet communicated with the air inlet channel.

With the above structure, the air flow channel is disposed reasonably: during smoking, the air inflow direction is opposite to the smoke spraying direction of the ultrasonic atomization sheet, so that large particles of e-liquid splashed by the ultrasonic atomization sheet are brought back to the atomization region by the inflow air for re-atomization, the utilization rate of e-liquid is high, small particles of smoke are sucked into the mouth by the user along with the air flow, and the smoke sucked into the mouth is relatively delicate. At the same time, the phenomenon of sucking large particles of e-liquid in the smoke or scalding the mouth can also be avoided, and the smoking experience is good. Moreover, since the air inlet is formed at the end of the suction portion close to the nozzle holder, the air inlet will not be blocked by a hand, and the user experience is good.

As a preferred mode, the air inlet channel is opposite to the center of the atomization region of the ultrasonic atomization sheet, and the air inlet channel is perpendicular to the ultrasonic atomization sheet.

In order to improve the re-atomization effect on the large particles of e-liquid brought back to the atomization region along with the air flow, the air inlet channel is opposite to the center of the atomization region of the ultrasonic atomization sheet, and the air inlet channel is perpendicular to the ultrasonic atomization sheet.

Further, an e-liquid chamber and an e-liquid guide cotton for communicating the e-liquid chamber with an atomization surface of the ultrasonic atomization sheet are disposed in the housing, and an atomization cotton is sandwiched between the e-liquid guide cotton and the atomization surface of the ultrasonic atomization sheet.

As the atomization cotton is added, two layers of cotton are correspondingly disposed in the center of the ultrasonic atomization sheet, which not only can ensure the amount of e-liquid transmitted, but also can prevent the e-liquid guide cotton from being rapidly broken by high frequency oscillation, so that the service lives of the e-liquid guide cotton is prolonged, therefore the service live of the ultrasonic atomization sheet and the entire atomizer are prolonged.

As a preferred mode, an e-liquid chamber and an e-liquid guide cotton for communicating the e-liquid chamber with an atomization surface of the ultrasonic atomization sheet are further disposed in the housing, a connecting sleeve is further disposed in the housing, an air inlet tube is disposed in the connecting sleeve, and the top of a side wall of the connecting sleeve is provided with an air passing hole for communicating the air inlet with the air inlet tube; the inner of the connecting sleeve is further provided with an inner sleeve and an outer sleeve sleeved on the inner sleeve; the e-liquid guide cotton is cup-shaped, and the side wall of the e-liquid guide cotton is sandwiched between the inner sleeve and the outer sleeve; the connecting sleeve is provided with a first e-liquid passing hole, the outer sleeve is provided with a second e-liquid passing hole, and the e-liquid chamber, the first e-liquid passing hole, the second e-liquid passing hole, and the e-liquid guide cotton are sequentially communicated; the air outlet channel is formed between the inner wall of the inner sleeve and the outer wall of the air inlet tube, and the top surface of the connecting sleeve is provided with an air outlet for communicating the air outlet channel with the suction portion.

Further, the first e-liquid passing hole is disposed at the same height as the second e-liquid passing hole, and the nozzle assembly can drive the connecting sleeve to rotate relative to the side wall of the outer sleeve.

With the above structure, when the cigarette is not being used, using the nozzle assembly to drive the connecting sleeve to rotate relative to the side wall of the outer sleeve, so that the first e-liquid passing hole and the second e-liquid passing hole are misaligned to cut off the e-liquid path between the e-liquid guide cotton and the e-liquid chamber, so that the phenomena of e-liquid leakage and e-liquid immersion are avoided, and the atomization start speed of the ultrasonic atomization sheet is fast. Further, the atomizer further comprises a spring, one end of the spring abuts against a step portion of the inner side wall of the inner sleeve, and the other end of the spring abuts against the inner bottom surface of the e-liquid guide cotton.

The spring can ensure a reliable connection between the e-liquid guide cotton and the ultrasonic atomization sheet.

As another preferred mode, the angle between the center line of the air inlet channel and the center line of the ultrasonic atomization sheet is $\beta$, which is 5° to 85°, preferably 45° to 70°.

Further, an inlet of the air outlet channel is opposite to the atomization region of the ultrasonic atomization sheet, and the angle between the center line of the air outlet channel and the center line of the ultrasonic atomization sheet is $\alpha$, which is 5° to 85°, preferably 45° to 70°.

With the above structure, the component direction of the smoke spraying direction on the center line of the air inlet channel is opposite to the air inflow direction, large particles of e-liquid are returned under the force in the air flow direction and re-atomized, and fine particles of smoke are delivered to a user's mouth, so that the mouthfeel of smoke is improved and the utilization rate of e-liquid is high. During standing, the large particles of e-liquid on the air channel wall drop to the atomization surface of the ultrasonic atomization sheet under the action of gravity, and can be atomized again. An angle $\alpha$ is formed between the smoke spraying direction of the ultrasonic atomization sheet and the center line of the air outlet channel, so that the smoke is not directly sprayed to the user's mouth. The large particles of e-liquid are blocked by the side wall of the air outlet channel, so that the phenomenon of sucking large particles of e-liquid in the smoke or scalding the mouth is avoided, resulting in good taste of the smoke and good user experience.

As a preferred mode, a vent tube is disposed in the housing, the bottom of the vent tube is opposite to the atomization region of the ultrasonic atomization sheet, and the top of the vent tube is communicated with the nozzle assembly; a partition plate that partitions the vent tube into a first cavity and a second cavity is disposed in the vent tube; the first cavity forms the air inlet channel, and the second cavity forms the air outlet channel.

Further, the bottom of the vent tube is also connected with a silicone member, the silicone member is provided with a first through hole communicating the atomization region of the ultrasonic atomization sheet with the first cavity and a second through hole communicating the atomization region of the ultrasonic atomization sheet with the second cavity, and a sheet capable of fluttering with the air flow is further disposed on the silicone member corresponding to the position of partition plate; when the smoke is sucked, an air gap is formed between the sheet and the side wall of the air outlet channel.

With the above structure, during smoking, the sheet flutters toward the inlet of the air outlet channel along with the air flow direction, so that the sheet can block part of large particles of e-liquid sprayed along with the smoke. Since the air gap is formed between the sheet and the side wall of the air outlet channel when the smoke is sucked, the sheet does not block the smoke inlet of the air outlet channel.

As a preferred mode, the center line of the vent tube is parallel to the center line of the housing; the bottom of the housing is connected to a base through a connecting seat, and the ultrasonic atomization sheet is fixed on the base through a silicone seat; an e-liquid chamber and an e-liquid guide structure for communicating the e-liquid chamber with the atomization surface of the ultrasonic atomization sheet are further disposed in the housing.

The atomizer of the above structure is simple in structure and convenient to assemble. As a preferred mode, the e-liquid guide structure comprises an e-liquid storage cotton and a cup-shaped atomization cotton, an atomization core inner sleeve is sleeved outside the lower section of the vent tube, the cup-shaped atomization cotton is sleeved outside the atomization core inner sleeve, the e-liquid storage cotton is sleeved between an atomization core outer sleeve and the cup-shaped atomization cotton, and the outer bottom surface of the cup-shaped atomization cotton is connected to the ultrasonic atomization sheet; the side wall of the atomization core outer sleeve is provided with an e-liquid outlet for communicating the e-liquid chamber with the e-liquid storage cotton.

Further, a spring is further disposed in the cup-shaped atomization cotton, the bottom end of the spring abuts against the inner bottom surface of the cup-shaped atomization cotton, and the top end of the spring abuts against a step portion on the inner side wall of the atomization core inner sleeve.

The spring can ensure good contact between the cup-shaped atomization cotton and the ultrasonic atomization sheet, resulting in good atomization effect and large amount of smoke.

As a preferred mode, the connecting seat is provided with an e-liquid cover portion, and the e-liquid chamber is surrounded by the top surface of the e-liquid cover portion, the inner side wall of the housing, the outer side wall of the vent tube, and the outer side wall of the atomization core outer sleeve; the edge of the silicone seat abuts against the bottom surface of the e-liquid cover portion.

After the base is connected to the connecting seat, the edge of the silicone seat abuts against the bottom surface of the e-liquid cover portion, so that the smoke generated by atomization of the ultrasonic atomization sheet is not diffused.

Based on the same inventive concept, the present invention further provides an electronic cigarette, comprising a power supply and the ultrasonic electronic cigarette atomizer, and the power supply is electrically connected to the ultrasonic atomization sheet.

Compared with the prior art, the air flow channel of the present invention is disposed reasonably, and the smoke generated by atomization is not directly sprayed into the user's mouth, so that the phenomenon of sucking large particles of e-liquid in the smoke or scalding the mouth is avoided, the taste of the smoke is good, the utilization rate of e-liquid is high, and the air inlet is not blocked by a hand; a layer of atomization cotton is added to prolong the service lives of the ultrasonic atomization sheet and the atomizer; the e-liquid channel can be cut off to avoid the phenomena of e-liquid leakage and e-liquid immersion, and the atomization start speed is fast; the atomizer is simple in structure, convenient to assemble, and good in user experience.

Figure 1:
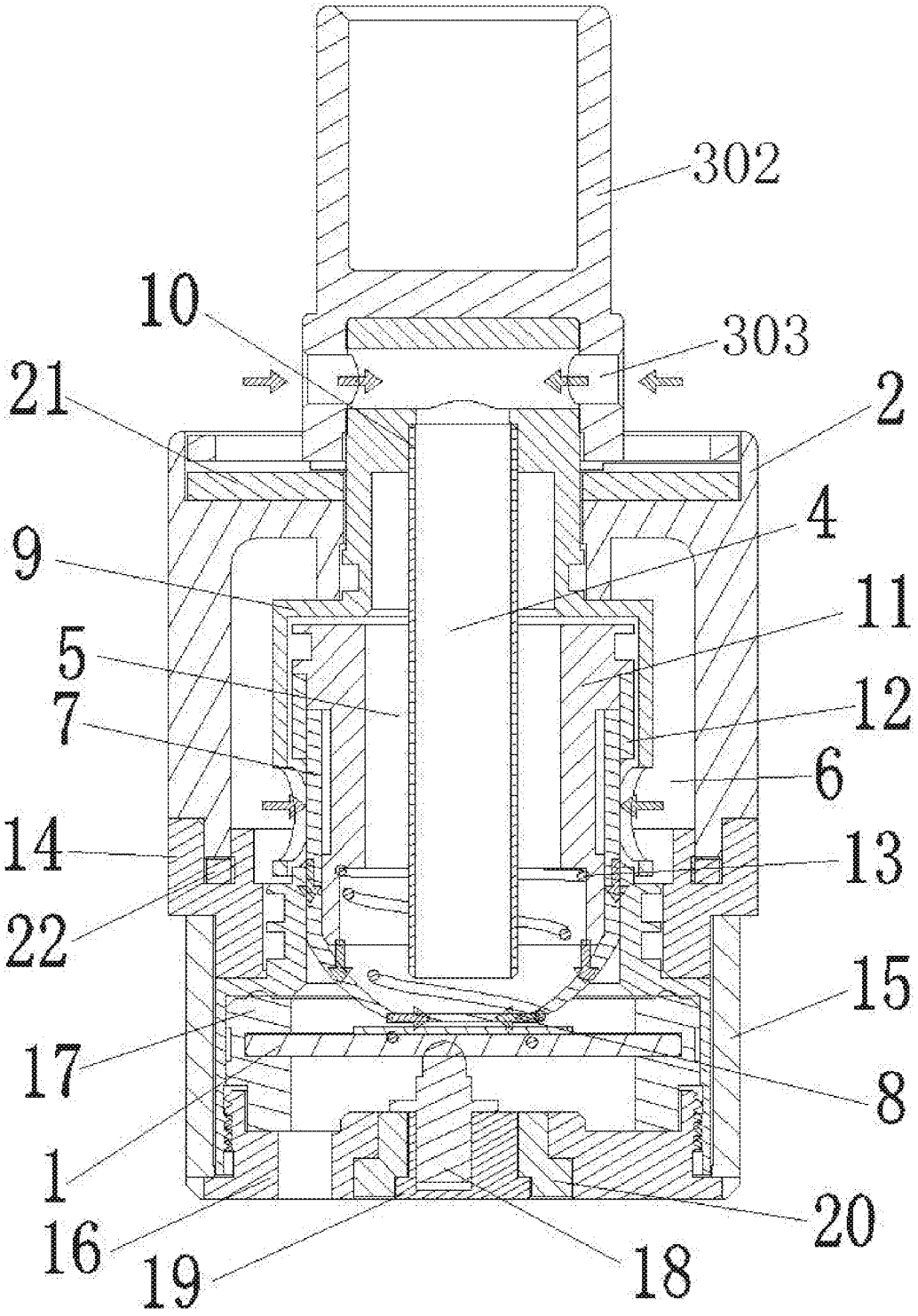
FIG. 1 is a front cross-sectional view of Embodiment 1 of an atomizer.
Figure 2:
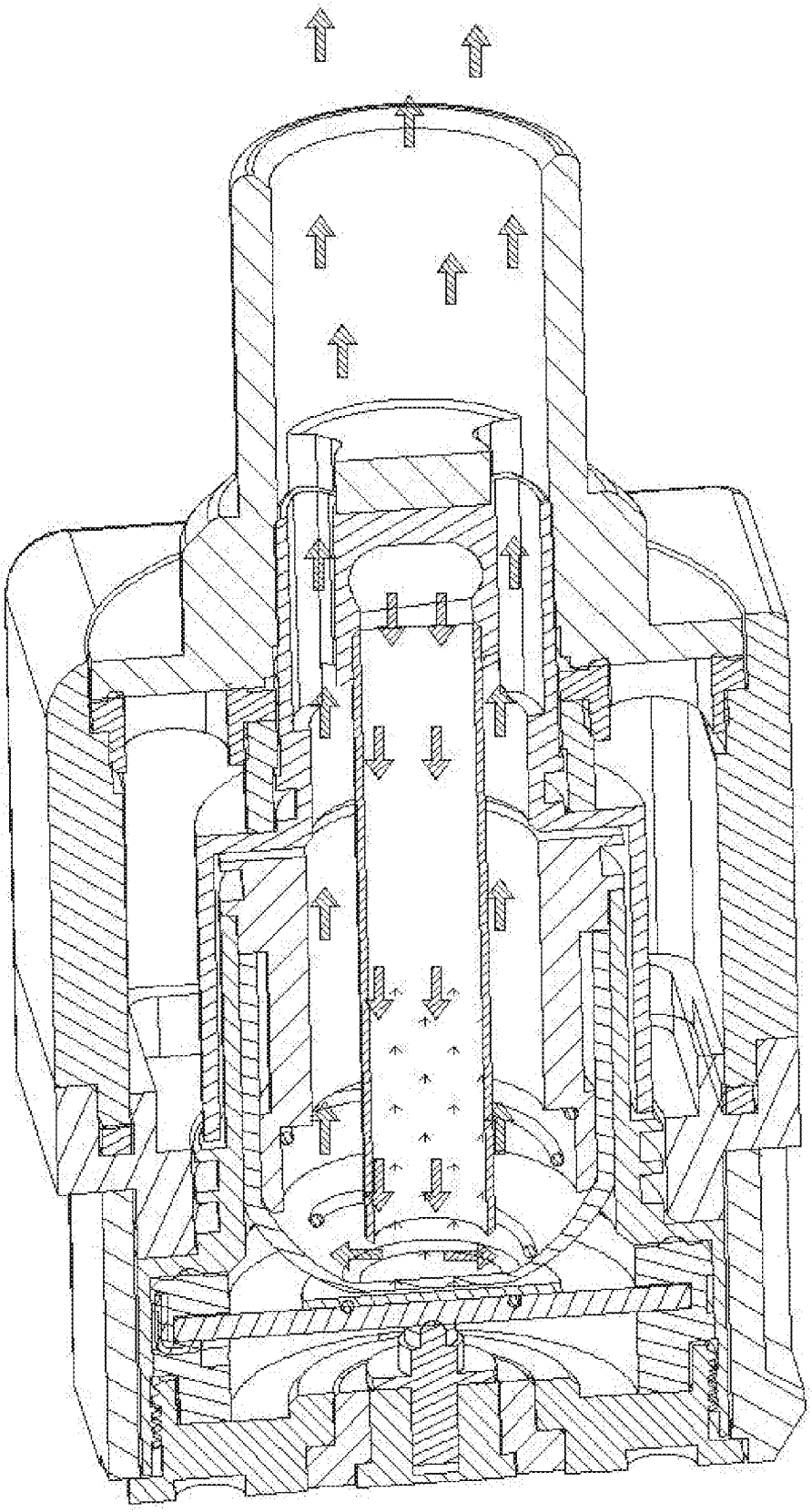
FIG. 2 is an oblique cross-sectional view of Embodiment 1 of the atomizer.
Figure 3:
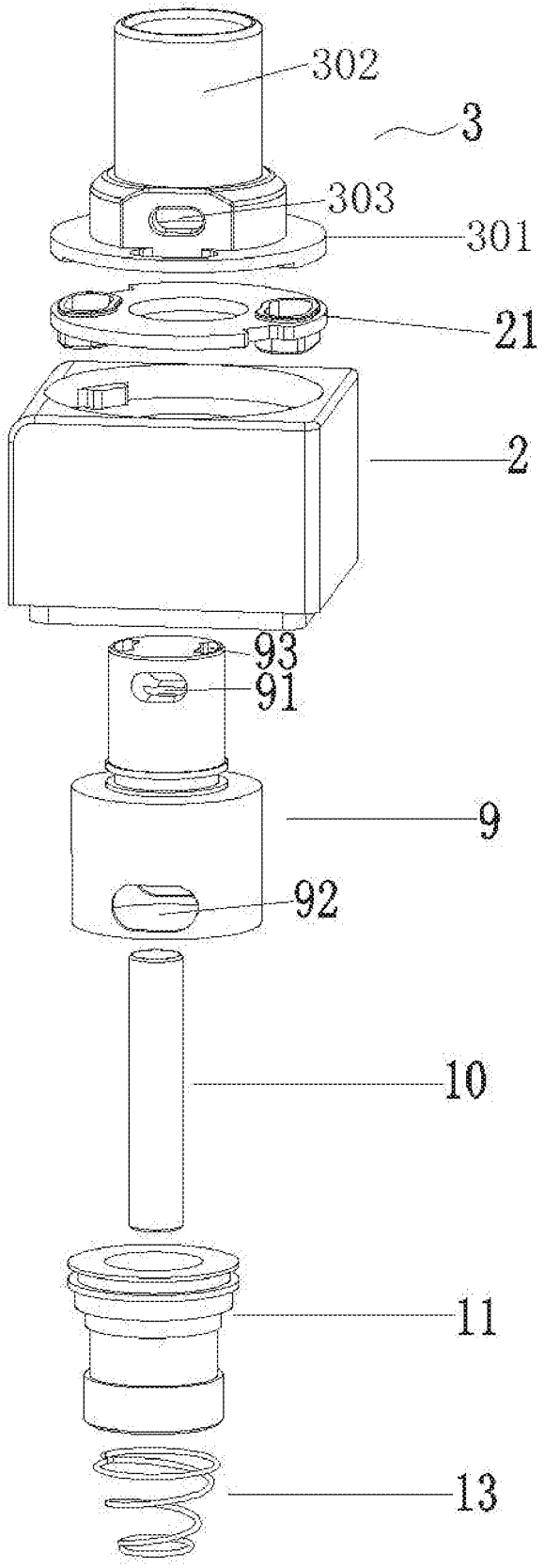
FIG. 3 is the upper part of an exploded view of FIG. 1.
Figure 4:
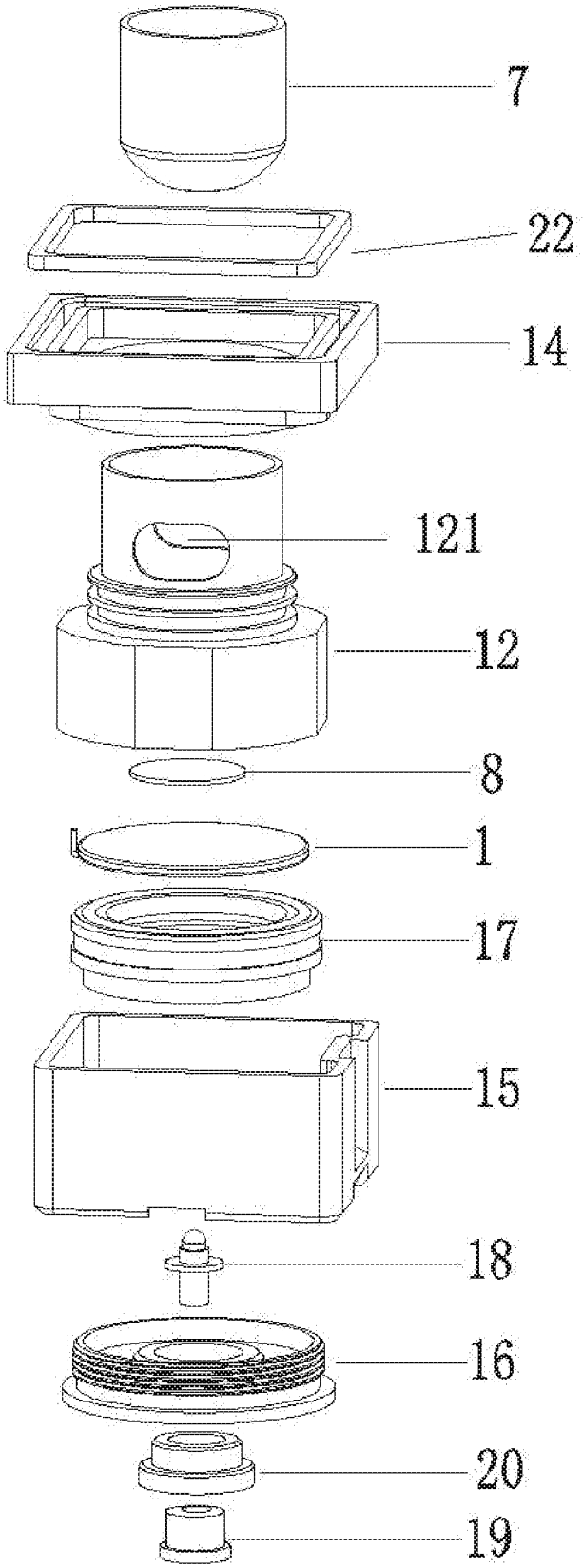
FIG. 4 is the lower part of the exploded view of FIG. 1.

In which, 1 ultrasonic atomization sheet, 2 housing, 3 nozzle assembly, 301 nozzle holder, 302 suction portion, 303 air inlet, 4 air inlet channel, 5 air outlet channel, 6 e-liquid chamber, 7 e-liquid guide cotton, 8 atomization cotton, 9 connecting sleeve, 91 air passing hole, 92 first e-liquid passing hole, 93 air outlet, 10 air inlet tube, 11 inner sleeve, 12 outer sleeve, 121 second e-liquid passing hole, 13 spring, 14 lower cover, 15 bottom cover, 16 external threaded seat, 17 atomization seat, 18 spring electrode, 19 lower electrode, 20 insulating ring, 21 gasket, 22 seal ring, 201 vent tube, 202 partition plate, 23 silicone member, 2301 first through hole, 2302 second through hole, 2303 sheet, 24 air gap, 25 connecting seat, 2501 e-liquid cover portion, 26 base, 27 silicone seat, 28 e-liquid storage cotton, 1201 e-liquid outlet, 29 inner electrode, 30 silicone ring, I e-liquid storage assembly, II atomization assembly.

DETAILED DESCRIPTION OF EMBODIMENTS

Embodiment 1

As shown in FIG. 1 to FIG. 4, Embodiment 1 of an ultrasonic electronic cigarette atomizer comprises a housing 2, a nozzle assembly 3 is connected to one end of the housing 2, and an air inlet channel 4, an air outlet channel 5 and an ultrasonic atomization sheet 1 are disposed in the housing 2, wherein the air inlet channel 4, an atomization region of the ultrasonic atomization sheet 1, and the air outlet channel 5 are sequentially communicated; the atomizer has the structural characteristics that an outlet of the air inlet channel 4 is opposite to the atomization region of the ultrasonic atomization sheet 1; the nozzle assembly 3 comprises a nozzle holder 301 mounted to one end of the housing 2, and a suction portion 302 on the nozzle holder 301 communicated with the air outlet channel 5, and the end of the suction portion 302 close to the nozzle holder 301 is provided with an air inlet 303 communicated with the air inlet channel 4.

The air inlet channel 4 is opposite to the center of the atomization region of the ultrasonic atomization sheet 1, and the air inlet channel 4 is perpendicular to the ultrasonic atomization sheet 1.

An e-liquid chamber 6 and an e-liquid guide cotton 7 for communicating the e-liquid chamber 6 with the atomization surface of the ultrasonic atomization sheet 1 are further disposed in the housing 2, and an atomization cotton 8 is sandwiched between the e-liquid guide cotton 7 and the atomization surface of the ultrasonic atomization sheet 1.

A connecting sleeve 9 is further disposed in the housing 2, an air inlet tube 10 is disposed in the connecting sleeve 9, and the top of a side wall of the connecting sleeve 9 is provided with an air passing hole 91 for communicating the air inlet 303 with the air inlet tube 10; an inner sleeve 11 and an outer sleeve 12 which are connected with each other in a sleeved way are further disposed in the connecting sleeve 9, the e-liquid guide cotton 7 is cup-shaped, and the side wall of the e-liquid guide cotton 7 is sandwiched between the inner sleeve 11 and the outer sleeve 12; the connecting sleeve 9 is provided with a first e-liquid passing hole 92, the outer sleeve 12 is provided with a second e-liquid passing hole 121, and the e-liquid chamber 6, the first e-liquid passing hole 92, the second e-liquid passing hole 121, and the e-liquid guide cotton 7 are sequentially communicated; the air outlet channel 5 is formed between the inner wall of the inner sleeve 11 and the outer wall of the air inlet tube 10, and the top surface of the connecting sleeve 9 is provided with an air outlet 93 for communicating the air outlet channel 5 with the suction portion 302. The shaded arrows in FIG. 2 indicate an air flow direction, and small solid arrows indicate a splashing direction of large particles of e-liquid.

The first e-liquid passing hole 92 is disposed at the same height as the second e-liquid passing hole 121, and the nozzle assembly 3 can drive the connecting sleeve 9 to rotate relative to the side wall of the outer sleeve 12.

A spring 13 is disposed in the housing 2, one end of the spring 13 abuts against a step portion of the inner side wall of the inner sleeve 11, and the other end of the spring 13 abuts against the inner bottom surface of the e-liquid guide cotton 7.

The bottom of the housing 2 is sequentially connected with a lower cover 14, a bottom cover 15 and an external threaded seat 16, and the ultrasonic atomization sheet 1 is fixed through an atomization seat 17 on the external threaded seat 16; a spring electrode 18 whose top end abuts against the bottom surface of the ultrasonic atomization sheet 1 is disposed in the external threaded seat 16, the bottom of the spring electrode 18 is connected with a lower electrode 19 in a sleeved way, and the lower electrode 19 is connected to the external threaded seat 16 in an insulation way by an insulating ring 20.

A gasket 21 is disposed between the nozzle holder 301 and the housing 2. A seal ring 22 is disposed between the lower cover 14 and the housing 2.

The ultrasonic atomization sheet 1 is a piezoelectric ceramic sheet.

Figure 5:
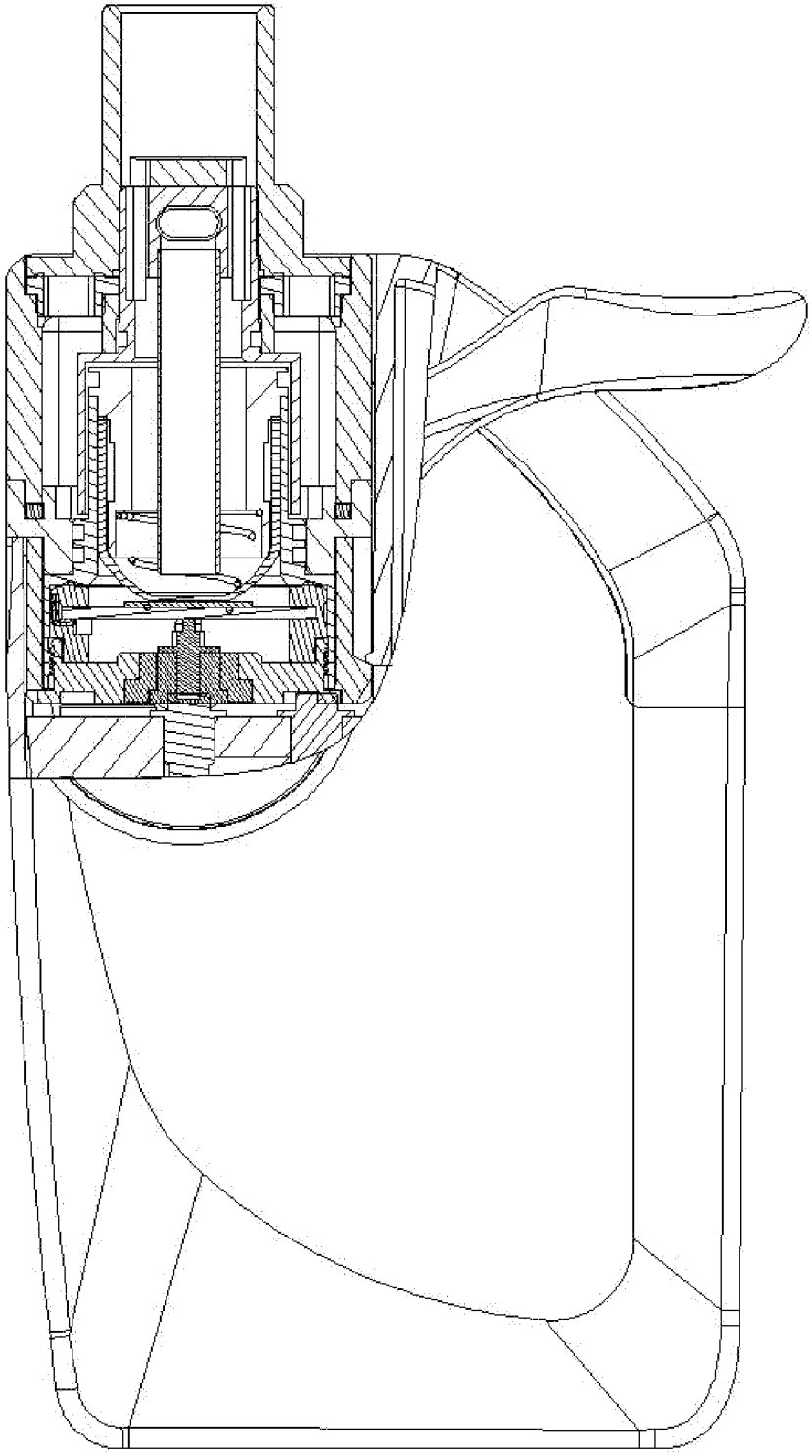
FIG. 5 is a structural schematic diagram of Embodiment 1 of an electronic cigarette.
Figure 6:
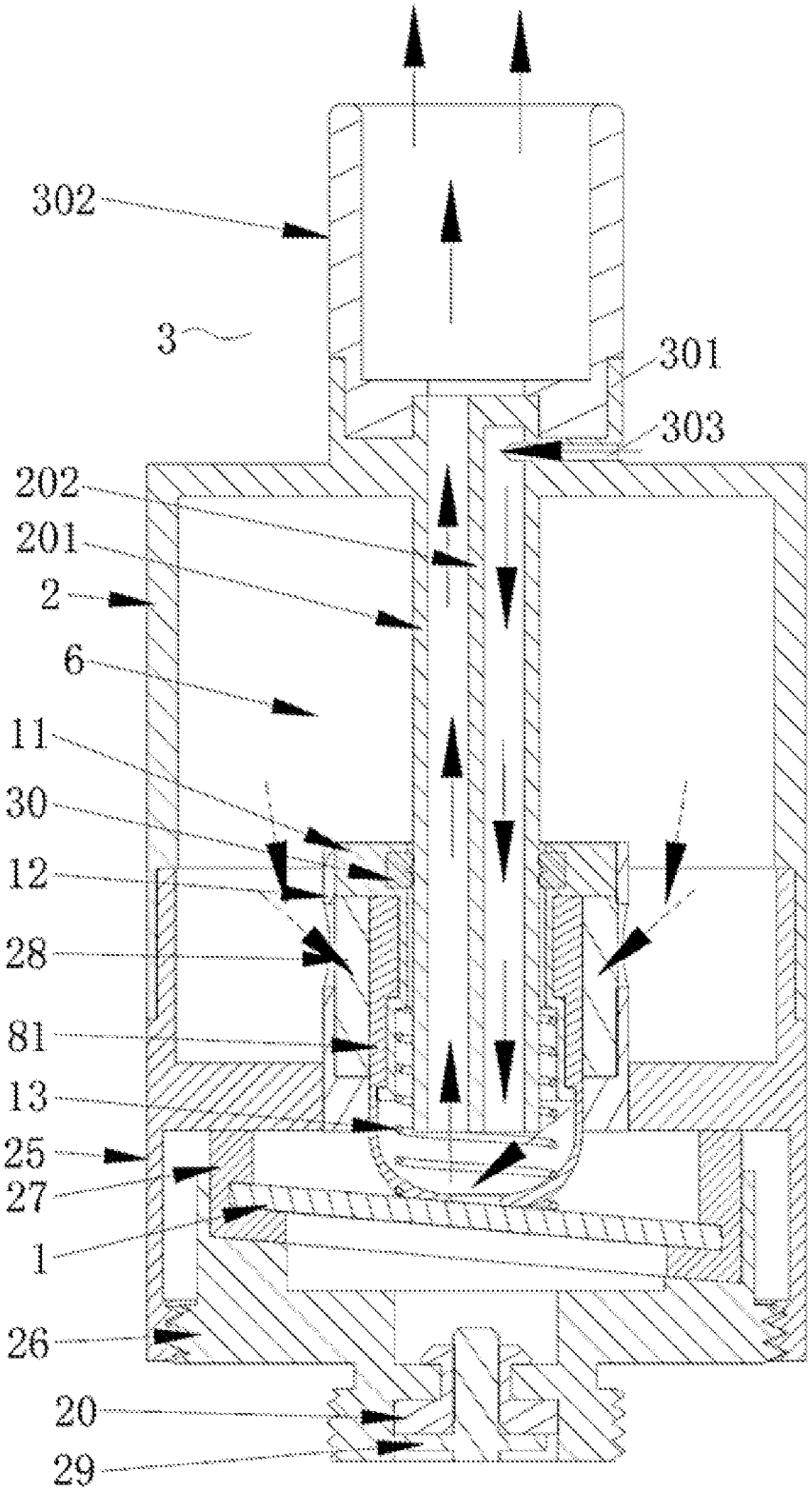
FIG. 6 is a front cross-sectional view of Embodiment 2 of an atomizer.
Figure 7:
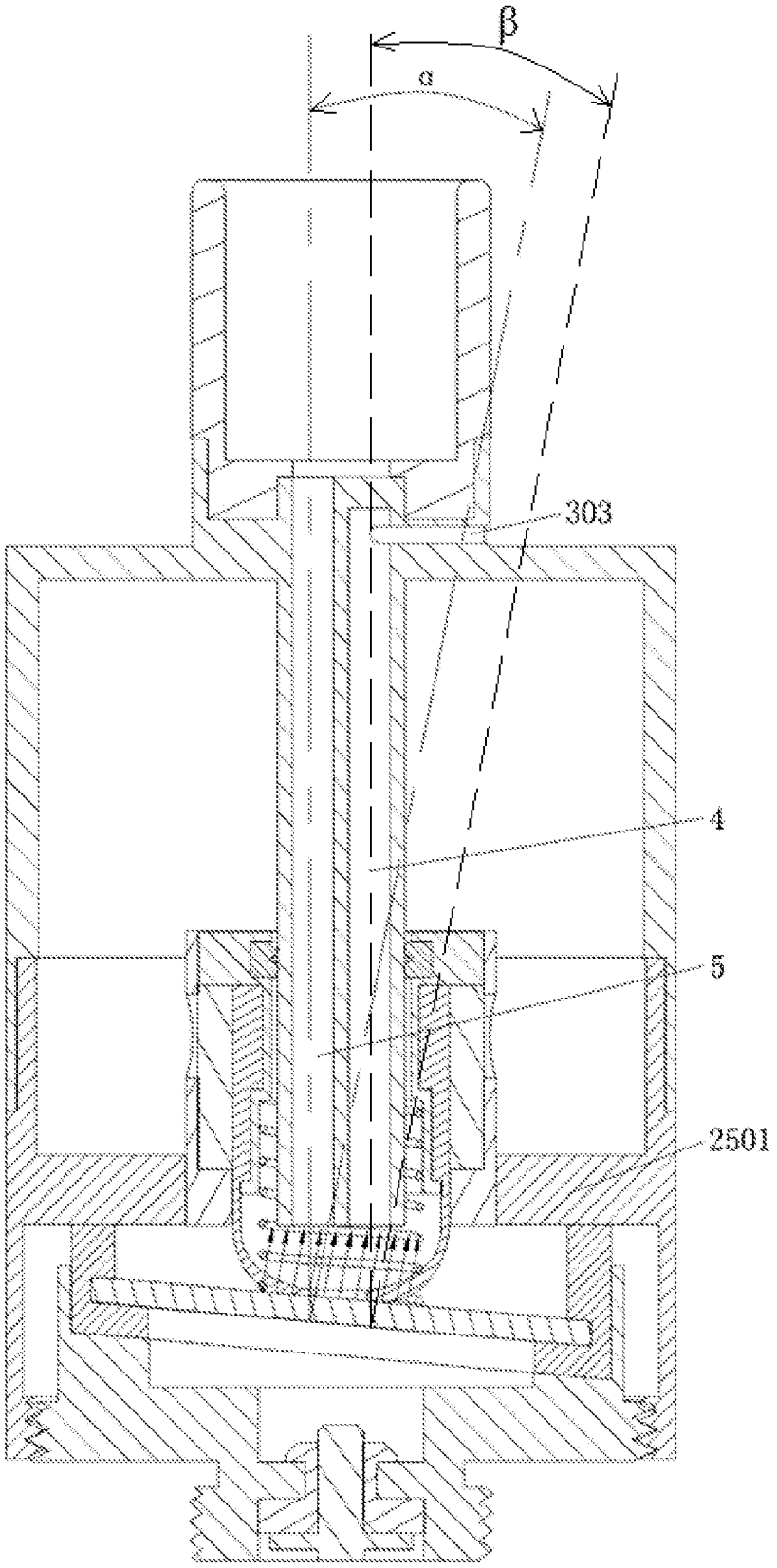
FIG. 7 is an angle diagram of Embodiment 2 of the atomizer.

As shown in FIG. 5, in an embodiment of an electronic cigarette, the electronic cigarette comprises a power supply and the above-mentioned ultrasonic electronic cigarette atomizer, and the power supply is electrically connected to the ultrasonic atomization sheet 1.

Embodiment 2

As shown in FIG. 6 to FIG. 9, Embodiment 2 of an ultrasonic electronic cigarette atomizer comprises a housing 2, a nozzle assembly 3 is connected to one end of the housing 2, and an air inlet channel 4, an air outlet channel 5 and an ultrasonic atomization sheet 1 are disposed in the housing 2, wherein the air inlet channel 4, an atomization region of the ultrasonic atomization sheet 1, and the air outlet channel 5 are sequentially communicated; the atomizer is characterized in that an outlet of the air inlet channel 4 is opposite to the atomization region of the ultrasonic atomization sheet 1; the nozzle assembly 3 comprises a nozzle holder 301 mounted to one end of the housing 2, and a suction portion 302 on the nozzle holder 301 communicated with the air outlet channel 5, and the end of the suction portion 302 close to the nozzle holder 301 is provided with an air inlet 303 communicated with the air inlet channel 4.

The angle between the center line of the air inlet channel 4 and the center line of the ultrasonic atomization sheet 1 is $\beta$, which is 5° to 85°, preferably 45° to 70°.

An inlet of the air outlet channel 5 is opposite to the atomization region of the ultrasonic atomization sheet 1, and the angle between the center line of the air outlet channel 5 and the center line of the ultrasonic atomization sheet 1 is $\alpha$, which is 5° to 85°, preferably 45° to 70°. In the present embodiment, $\alpha=\beta$.

A vent tube 201 is disposed in the housing 2, the bottom of the vent tube 201 is opposite to the atomization region of the ultrasonic atomization sheet 1, and the top of the vent tube 201 is communicated with the nozzle assembly 3; a partition plate 202 that partitions the vent tube 201 into a first cavity and a second cavity is disposed in the vent tube 201; the first cavity forms the air inlet channel 4, and the second cavity forms the air outlet channel 5. The solid arrows in FIG. 6 indicate an air flow direction.

The center line of the vent tube 201 is parallel to the center line of the housing 2; the bottom of the housing 2 is connected to a base 26 through a connecting seat 25, and the ultrasonic atomization sheet 1 is fixed on the base 26 through a silicone seat 27; an e-liquid chamber 6 and an e-liquid guide structure for communicating the e-liquid chamber 6 with an atomization surface of the ultrasonic atomization sheet 1 are further disposed in the housing 2. The arrows in FIG. 7 indicate a spraying direction of smoke generated when the ultrasonic atomization sheet 1 atomizes e-liquid.

The e-liquid guide structure comprises an e-liquid storage cotton 28 and a cup-shaped atomization cotton 81, an inner sleeve 11 is sleeved outside the lower section of the vent tube 201, the cup-shaped atomization cotton 81 is sleeved outside the inner sleeve 11, the e-liquid storage cotton 28 is sleeved between an outer sleeve 12 and the cup-shaped atomization cotton 81, and the outer bottom surface of the cup-shaped atomization cotton 81 is connected to the ultrasonic atomization sheet 1; the side wall of the outer sleeve 12 is provided with an e-liquid outlet 1201 for communicating the e-liquid chamber 6 with the e-liquid storage cotton 28. The dotted arrows in FIG. 6 indicate an e-liquid channel direction.

The air outlet of the air inlet channel 4 should be disposed in the middle of the atomization region of the ultrasonic atomization sheet las far as possible, so that large particles of e-liquid fall onto the cup-shaped atomization cotton 81 as much as possible.

A spring 13 is further disposed in the cup-shaped atomization cotton 81, the bottom end of the spring 13 abuts against the inner bottom surface of the cup-shaped atomization cotton 81, and the top end of the spring 13 abuts against a step portion on the inner side wall of the inner sleeve 11.

The connecting seat 25 is provided with an e-liquid cover portion 2501, and the e-liquid chamber 6 is surrounded by the top surface of the e-liquid cover portion 2501, the inner side wall of the housing 2, the outer side wall of the vent tube 201, and the outer side wall of the outer sleeve 12; the edge of the silicone seat 27 abuts against the bottom surface of the e-liquid cover portion 2501. A silicone ring 30 for sealing e-liquid is sleeved between the inner sleeve 11 and the vent tube 201.

An inner electrode 29 is disposed in the base 26, and the inner electrode 29 is connected to the base 26 in an insulation way by an insulating ring 20.

Figure 8:
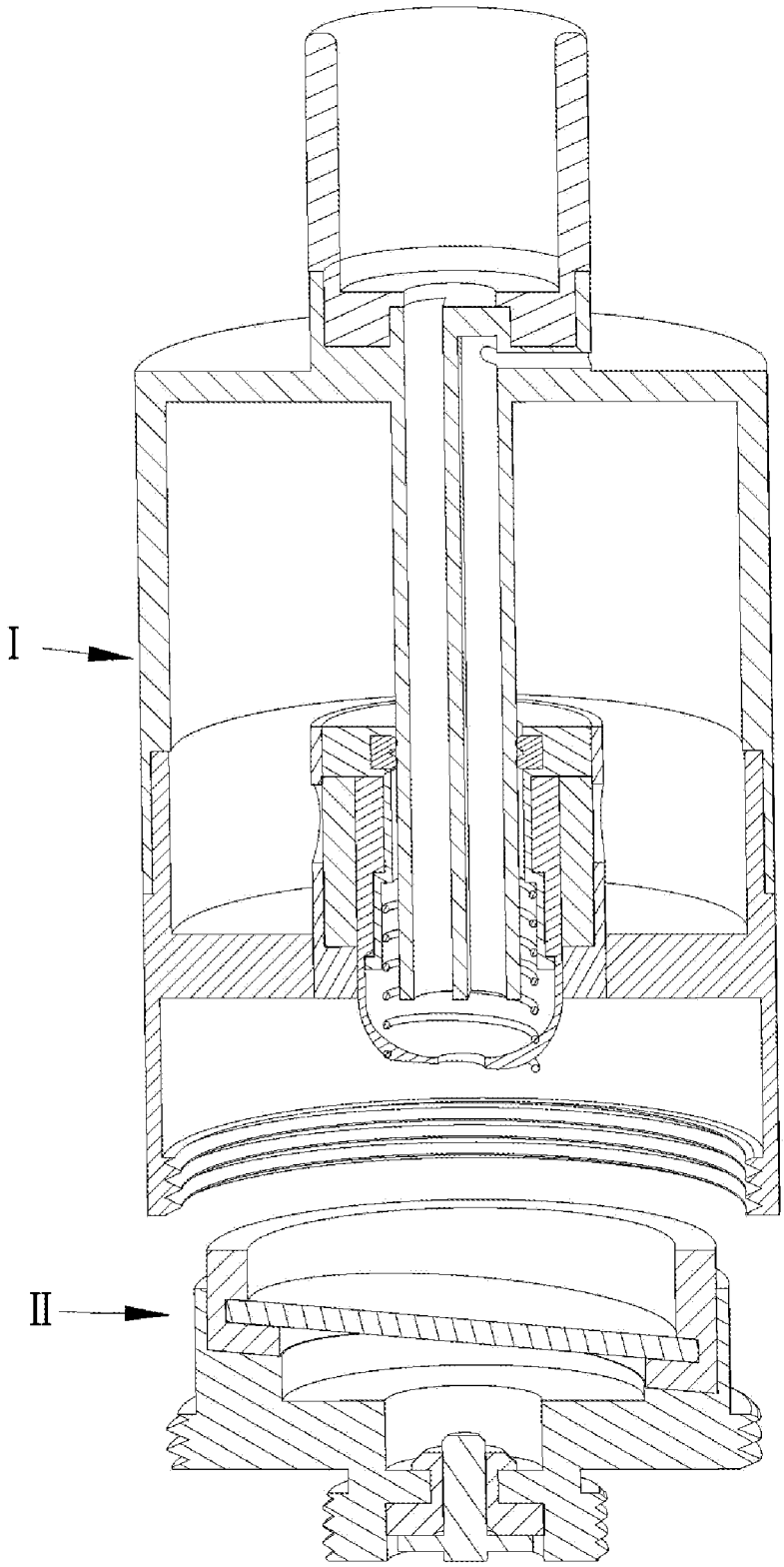
FIG. 8 is an exploded view of components of FIG. 6.
Figure 9:
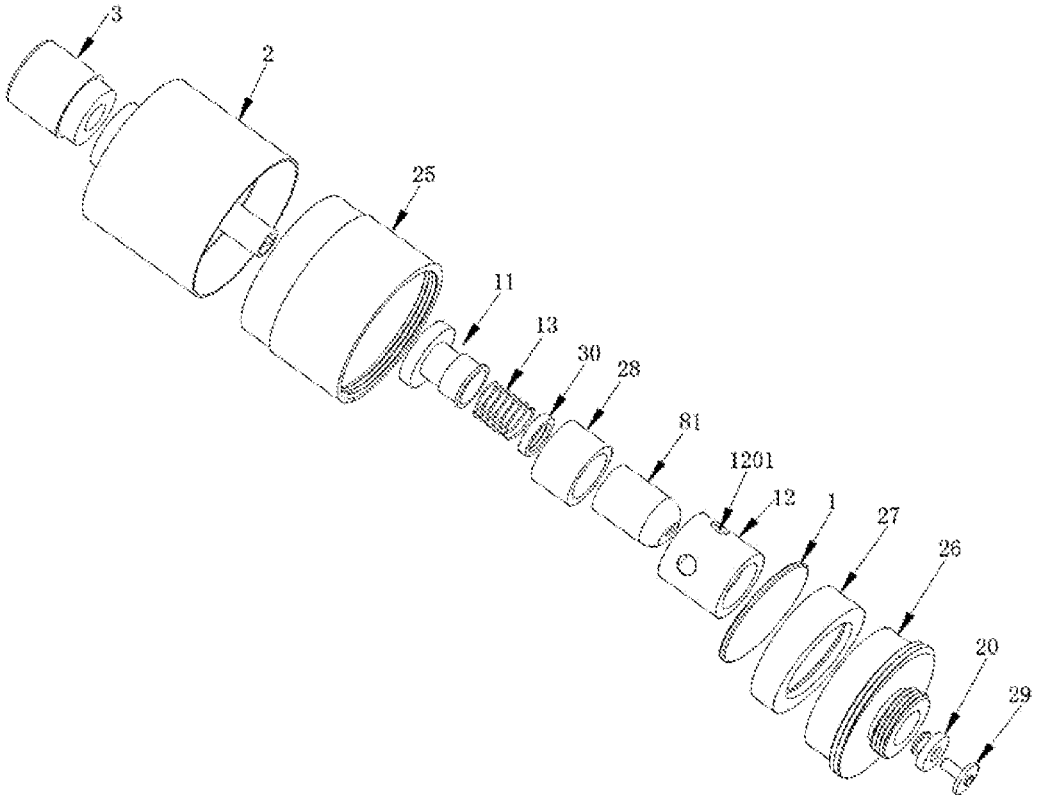
FIG. 9 is an exploded view of FIG. 6.

As shown in FIG. 8, the entire atomizer is composed of an e-liquid storage assembly I and an atomization assembly II. The connecting seat 25 is screwed to the base 26 to realize detachable connection of the e-liquid storage assembly I and the atomization assembly II. The bottom of the base 26 is provided with external threads to facilitate detachable connection to a battery assembly.

The electronic cigarette of the present invention comprises a power supply and the above-mentioned ultrasonic electronic cigarette atomizer, and the power supply is electrically connected to the ultrasonic atomization sheet 1.

Embodiment 3

Figure 10:
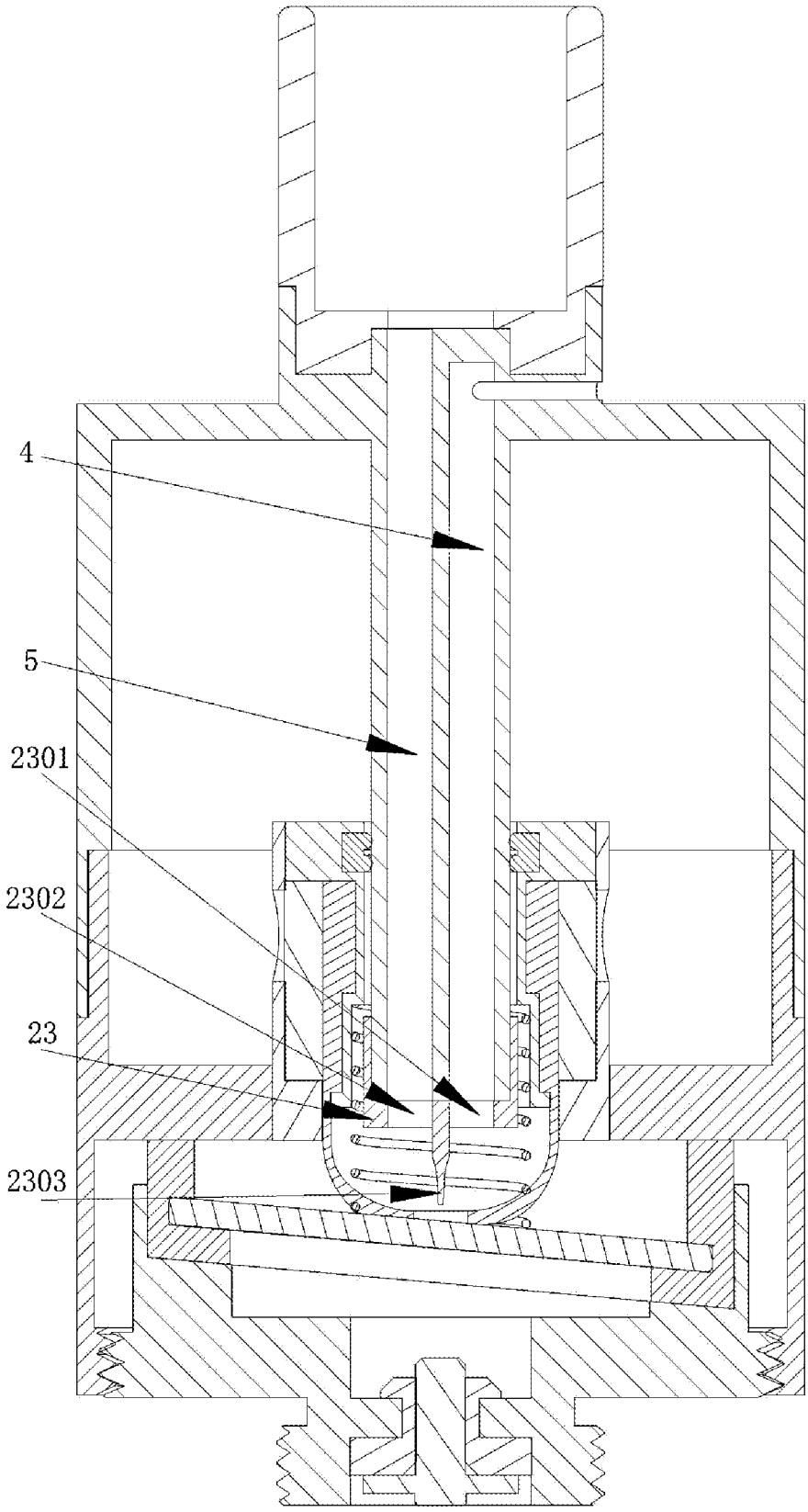
FIG. 10 is a front cross-sectional view of Embodiment 3 of an atomizer.
Figure 11:
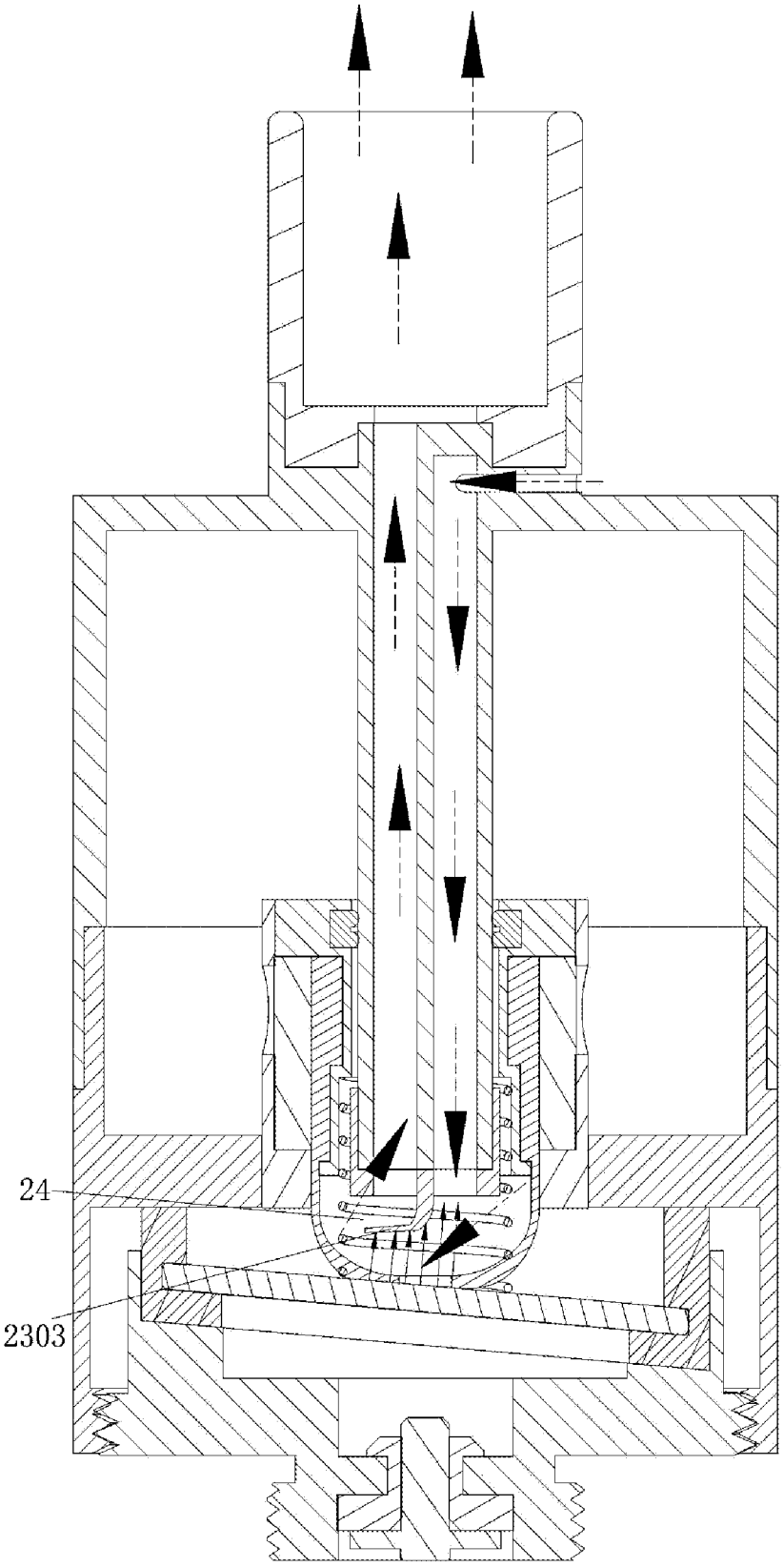
FIG. 11 is a use state diagram of FIG. 10.

FIG. 10 and FIG. 11 show a structure of Embodiment 3 of the atomizer. Embodiment 3 is the same as Embodiment 2, the differences are that the bottom of the vent tube 201 is further connected with a silicone member 23, the silicone member 23 is provided with a first through hole 2301 communicating the atomization region of the ultrasonic atomization sheet 1 with the first cavity and a second through hole 2302 communicating the atomization region of the ultrasonic atomization sheet 1 with the second cavity, and a sheet 2303 capable of fluttering with the air flow is disposed on the silicone member 23 corresponding to the position of partition plate 202. As shown in FIG. 11, when the smoke is sucked, an air gap 24 is formed between the sheet 2303 and the side wall of the air outlet channel 5. The solid arrows in FIG. 11 indicate a spraying direction of smoke generated when the ultrasonic atomization sheet 1 atomizes e-liquid. The dotted arrows in FIG. 11 indicate an air flow direction.

The same structure in Embodiment 3 as Embodiment 2 is not described herein, which does not affect the understanding and implementation of the present invention by those skilled in the art.

The embodiments of the present invention are described above with reference to the drawings, but the present invention is not limited to the specific embodiments. The specific embodiments described above are merely illustrative but not restrictive. Many forms may also be made by those of ordinary skill in the art under the enlightenment of the present invention without departing from the purpose of the present invention and the scope of the claims, and these forms fall into the scope of the present invention.

The invention claimed is:

1. An ultrasonic electronic cigarette atomizer, comprises a housing (2); a nozzle assembly (3) connected to one end of the housing (2); an air inlet channel (4), an air outlet channel (5), and an ultrasonic atomization sheet (1) disposed in the housing (2); wherein the air inlet channel (4), an atomization region of the ultrasonic atomization sheet (1), and the air outlet channel (5) are sequentially communicated; wherein an outlet of the air inlet channel (4) is opposite to the atomization region of the ultrasonic atomization sheet (1); wherein the nozzle assembly (3) comprises a nozzle holder (301) and a suction portion (302); wherein the nozzle holder (301) is mounted to one end of the housing (2); wherein the suction portion (302) is located on the nozzle holder (301) and is communicated with the air outlet channel (5); and wherein the end of the suction portion (302) that is close to the nozzle holder (301) is provided with an air inlet (303) communicated with the air inlet channel (4).

2. The ultrasonic electronic cigarette atomizer according to claim 1, wherein the air inlet channel (4) is opposite to the center of the atomization region of the ultrasonic atomization sheet (1), and wherein the air inlet channel (4) is perpendicular to the ultrasonic atomization sheet (1).

3. The ultrasonic electronic cigarette atomizer according to claim 2, wherein an e-liquid chamber (6) and an e-liquid guide cotton (7) for communicating the e-liquid chamber (6) with an atomization surface of the ultrasonic atomization sheet (1) are disposed in the housing (2), and wherein an atomization cotton (8) is sandwiched between the e-liquid guide cotton (7) and the atomization surface of the ultrasonic atomization sheet (1).

4. The ultrasonic electronic cigarette atomizer according to claim 2, wherein an e-liquid chamber (6) and an e-liquid guide cotton (7) for communicating the e-liquid chamber (6) with an atomization surface of the ultrasonic atomization sheet (1) are disposed in the housing (2), wherein a connecting sleeve (9) is disposed in the housing (2), wherein an air inlet tube (10) is disposed in the connecting sleeve (9), and wherein the top of a side wall of the connecting sleeve (9) is provided with an air passing hole (91) for communicating the air inlet (303) with the air inlet tube (10); wherein the inner of the connecting sleeve (9) is further provided with an inner sleeve (11) and an outer sleeve (12) sleeved on the inner sleeve (11); wherein the e-liquid guide cotton (7) is cup-shaped, and wherein the side wall of the e-liquid guide cotton (7) is sandwiched between the inner sleeve (11) and the outer sleeve (12); wherein the connecting sleeve (9) is provided with a first e-liquid passing hole (92), wherein the outer sleeve (12) is provided with a second e-liquid passing hole (121), and wherein the e-liquid chamber (6), the first e-liquid passing hole (92), the second e-liquid passing hole (121), and the e-liquid guide cotton (7) are sequentially communicated; wherein the air outlet channel (5) is formed between the inner wall of the inner sleeve (11) and the outer wall of the air inlet tube (10), and wherein the top surface of the connecting sleeve (9) is provided with an air outlet (93) for communicating the air outlet channel (5) with the suction portion (302).

5. The ultrasonic electronic cigarette atomizer according to claim 1, wherein an e-liquid chamber (6) and an e-liquid guide cotton (7) for communicating the e-liquid chamber (6) with an atomization surface of the ultrasonic atomization sheet (1) are disposed in the housing (2), and wherein an atomization cotton (8) is sandwiched between the e-liquid guide cotton (7) and the atomization surface of the ultrasonic atomization sheet (1).

6. The ultrasonic electronic cigarette atomizer according to claim 1, wherein an e-liquid chamber (6) and an e-liquid guide cotton (7) for communicating the e-liquid chamber (6) with an atomization surface of the ultrasonic atomization sheet (1) are disposed in the housing (2), wherein a connecting sleeve (9) is disposed in the housing (2), wherein an air inlet tube (10) is disposed in the connecting sleeve (9), and wherein the top of a side wall of the connecting sleeve (9) is provided with an air passing hole (91) for communicating the air inlet (303) with the air inlet tube (10); wherein the inner of the connecting sleeve (9) is further provided with an inner sleeve (11) and an outer sleeve (12) sleeved on the inner sleeve (11); wherein the e-liquid guide cotton (7) is cup-shaped, and wherein the side wall of the e-liquid guide cotton (7) is sandwiched between the inner sleeve (11) and the outer sleeve (12); wherein the connecting sleeve (9) is provided with a first e-liquid passing hole (92), wherein the outer sleeve (12) is provided with a second e-liquid passing hole (121), and wherein the e-liquid chamber (6), the first e-liquid passing hole (92), the second e-liquid passing hole (121); the e-liquid guide cotton (7) are sequentially communicated; wherein the air outlet channel (5) is formed between the inner wall of the inner sleeve (11) and the outer wall of the air inlet tube (10), and wherein the top surface of the connecting sleeve (9) is provided with an air outlet (93) for communicating the air outlet channel (5) with the suction portion (302).

7. The ultrasonic electronic cigarette atomizer according to claim 6, wherein the first e-liquid passing hole (92) is disposed at the same height as the second e-liquid passing hole (121), and wherein the nozzle assembly (3) can drive the connecting sleeve (9) to rotate relative to the side wall of the outer sleeve (12).

8. The ultrasonic electronic cigarette atomizer according to claim 6, wherein the ultrasonic electronic cigarette atomizer further comprises a spring (13), wherein one end of the spring (13) abuts against a step portion of the inner side wall of the inner sleeve (11), and wherein the other end of the spring (13) abuts against the inner bottom surface of the e-liquid guide cotton (7).

9. The ultrasonic electronic cigarette atomizer according to claim 1, wherein the angle between the center line of the air inlet channel (4) and the center line of the ultrasonic atomization sheet (1) is β, which is 5° to 85'; wherein β is preferably 45° to 70°.

10. The ultrasonic electronic cigarette atomizer according to claim 9, wherein an inlet of the air outlet channel (5) is opposite to the atomization region of the ultrasonic atomization sheet (1), and wherein the angle between the center line of the air outlet channel (5) and the center line of the ultrasonic atomization sheet (1) is α, which is 5° to 85°; wherein α is preferably 45° to 70°.

11. The ultrasonic electronic cigarette atomizer according to claim 10, wherein a vent tube (201) is disposed in the housing (2), wherein the bottom of the vent tube (201) is opposite to the atomization region of the ultrasonic atomization sheet (1), and wherein the top of the vent tube (201) is communicated with the nozzle assembly (3); wherein a partition plate (202) that partitions the vent tube (201) into a first cavity and a second cavity is disposed in the vent tube (201); wherein the first cavity forms the air inlet channel (4), and wherein the second cavity forms the air outlet channel (5).

12. The ultrasonic electronic cigarette atomizer according to claim 11, wherein the bottom of the vent tube (201) is further connected with a silicone member (23), wherein the silicone member (23) is provided with a first through hole (2301) communicating the atomization region of the ultrasonic atomization sheet (1) with the first cavity and a second through hole (2302) communicating the atomization region of the ultrasonic atomization sheet (1) with the second cavity, and wherein a sheet (2303) capable of fluttering with air flow is disposed on the silicone member (23) corresponding to the position of partition plate (202); and wherein when the smoke is sucked, an air gap (24) is formed between the sheet (2303) and the side wall of the air outlet channel (5).

13. The ultrasonic electronic cigarette atomizer according to claim 12, wherein the center line of the vent tube (201) is parallel to the center line of the housing (2); wherein the bottom of the housing (2) is connected to a base (26) through a connecting seat (25), and wherein the ultrasonic atomization sheet (1) is fixed on the base (26) through a silicone seat (27); wherein an e-liquid chamber (6) and an e-liquid guide structure for communicating the e-liquid chamber (6) with the atomization surface of the ultrasonic atomization sheet (1) are disposed in the housing (2).

14. The ultrasonic electronic cigarette atomizer according to claim 11, wherein the center line of the vent tube (201) is parallel to the center line of the housing (2); wherein the bottom of the housing (2) is connected to a base (26) through a connecting seat (25), and wherein the ultrasonic atomization sheet (1) is fixed on the base (26) through a silicone seat (27); wherein an e-liquid chamber (6) and an e-liquid guide structure for communicating the e-liquid chamber (6) with the atomization surface of the ultrasonic atomization sheet (1) are disposed in the housing (2).

15. The ultrasonic electronic cigarette atomizer according to claim 14, wherein the e-liquid guide structure comprises an e-liquid storage cotton (28) and a cup-shaped atomization cotton (81), wherein an inner sleeve (11) is sleeved on the lower section of the vent tube (201), wherein the cup-shaped atomization cotton (81) is sleeved on the inner sleeve (11), wherein the e-liquid storage cotton (28) is sleeved between an outer sleeve (12) and the cup-shaped atomization cotton (81), and wherein the outer bottom surface of the cup-shaped atomization cotton (81) is connected to the ultrasonic atomization sheet (1); wherein the side wall of the outer sleeve (12) is provided with an e-liquid outlet (1201) for communicating the e-liquid chamber (6) with the e-liquid storage cotton (28).

16. The ultrasonic electronic cigarette atomizer according to claim 15, wherein a spring (13) is further disposed in the cup-shaped atomization cotton (81), wherein the bottom end of the spring (13) abuts against the inner bottom surface of the cup-shaped atomization cotton (81), and wherein the top end of the spring (13) abuts against a step portion on the inner side wall of the inner sleeve (11).

17. The ultrasonic electronic cigarette atomizer according to claim 15, wherein the connecting seat (25) is provided with an e-liquid cover portion (2501), and wherein an atop surface of the e-liquid cover portion (2501), an inner side wall of the housing (2), an outer side wall of the vent tube (201), and an outer side wall of the outer sleeve (12) are enclosed to form the e-liquid chamber (6); and wherein the edge of the silicone seat (27) abuts against the bottom surface of the e-liquid cover portion (2501).

18. An electronic cigarette, comprises a power supply, wherein the electronic cigarette further comprises the ultrasonic electronic cigarette atomizer according to claim 1, wherein the power supply is electrically connected to the ultrasonic atomization sheet (1).

19. The electronic cigarette according to claim 18, wherein the air inlet channel (4) is opposite to the center of the atomization region of the ultrasonic atomization sheet (1), and wherein the air inlet channel (4) is perpendicular to the ultrasonic atomization sheet (1).

20. The electronic cigarette according to claim 18, wherein the angle between the center line of the air inlet channel (4) and the center line of the ultrasonic atomization sheet (1) is β, which is 5° to 85°; and wherein β is preferably 45° to 70°.

* * * * *